United States Patent [19]

Zamboni

[11] Patent Number: 4,539,791

[45] Date of Patent: Sep. 10, 1985

[54] CONTINUOUSLY MOVING HANDLING DEVICE FOR PACKING MACHINES IN PARTICULAR FOR SWEETS AND SIMILAR PRODUCTS

[75] Inventor: Alderino Zamboni, Budrio, Italy

[73] Assignee: Risvin - Ricerche E Sviluppo Industriale S.r.l, Bologna, Italy

[21] Appl. No.: 522,183

[22] Filed: Aug. 10, 1983

[30] Foreign Application Priority Data

Aug. 18, 1982 [IT] Italy ..... 3510 A/82

[51] Int. Cl.[3] ..... B65B 11/34

[52] U.S. Cl. ..... 53/234; 53/370; 53/227; 198/377

[58] Field of Search ..... 53/225, 325, 227, 228, 53/234, 370; 198/377, 443, 478, 480

[56] References Cited

U.S. PATENT DOCUMENTS

| | | | |
|---|---|---|---|
| 2,206,267 | 7/1940 | Schutz et al. | 198/377 |
| 2,744,370 | 5/1956 | Seragnoli | 53/277 X |
| 3,208,579 | 9/1965 | Perrier et al. | 198/377 X |
| 3,797,198 | 3/1974 | Fukuzaki | 53/227 X |
| 3,899,865 | 8/1975 | Revaz | 53/227 X |
| 3,987,605 | 10/1976 | Johnson | 53/370 X |
| 4,408,435 | 10/1983 | Sutton | 53/234 X |

FOREIGN PATENT DOCUMENTS 134621 3/1979 German Democratic Rep. ... 53/227

*Primary Examiner*—Paul A. Bell

*Attorney, Agent, or Firm*—Karl F. Ross; Herbert Dubno

[57] ABSTRACT

A handling device for packing machines in particular for sweets and similar products, having one or more continuously moving rotary wheels, comprising a support body which may be associated in a radially slideable manner with the said wheel or wheels having a predetermined number, a body having a head mounted to oscillate at the radially outermost end of the said support body about an axis parallel to the axis of rotation of the said wheel(s), operating means supported by the said headed body so as to be able to oscillate about axes parallel to the axis of rotation of the said oscillating headed body, and control means causing the said support body to slide radially with respect to the rotary wheel which supports it and causing the said head and the said operating means to oscillate so as to bring these latter means to operate with a continuous movement along a path having sections with a mixed course and to maintain them in constant orientation along and relative to these path sections.

2 Claims, 7 Drawing Figures

CONTINUOUSLY MOVING HANDLING DEVICE FOR PACKING MACHINES IN PARTICULAR FOR SWEETS AND SIMILAR PRODUCTS

DESCRIPTION

The present invention relates to a handling device for packing machines in particular for sweets and similar products which is provided with a continuous movement.

The handling of products or articles such as sweets and the like in order to provide these for example with a wrapper is normally carried out by conveying these products or articles along a circular path for the formation of this wrapper by means of folding means supported completely or in part by conveyor members provided with a discontinuous movement, i.e. periods of movement alternating with rest periods, at which means the products themselves are subjected to almost all the folding operations and/or the passage or transfer of these products or articles from a conveyor member to a subsequent member.

In the case of handling devices designed in this way, i.e. having conveyor members provided with a discontinuous movement in order to enable the products to be subjected to the majority of the above-mentioned folding operations and/or the transfer of the products themselves from a conveyor member to a further member during the rest periods of each alternation, the unit operating speed is necessarily somewhat limited which obviously leads to increased production costs.

In order to increase the unit operating speed of the above handling devices so as to decrease production costs for the corresponding products which are obtained and/or treated, various types of device or apparatus defined commercially as having a continuous movement have been proposed, although in actual practice these devices have proved to be nothing more than hybrids since, or at least during the stage of transfer of the product to be treated from operating means of a conveyor member to subsequent means of a further conveyor member, the product is at rest as it is released from the operating means of the preceding conveyor member or brought to a standstill by stop means and thus contacted for checking or taking up by the operating means of the following conveyor member with possible damage to the product itself and, in any case, with drawbacks relating to uniformity in the subsequent conveyor stage (see German Patent Specification No. 2 416 656) or even because these operating means are disposed facing away from one another at a single tangential point at the time of take-up of the product for its passage from one conveyor element to the next (see U.S. patent specification No. 3 001 351), or because the operating means are provided with a constant, i.e. high, circular conveying speed even for the more delicate handling operations such as, for example, the transfer or passage itself of the product from one conveyor element to the next, or even the more delicate operation of checking or taking up of the product and the various elements, such as wrapping materials, which may be involved in the handling operation, in particular during the supply stage to the operating means of the respective conveyor members.

The applicant's copending U.S. patent application Ser. No. 433,552, filed Oct. 8, 1983 discloses a method and a device for the handling of products by means of operating means caused to move continuously along a path having a mixed course with sections which are rectilinear, spiral, circular and curved in any way and which follow one another, although in an intercalated manner and at different speeds in accordance with the type of operation to be carried out on the product.

In accordance with this method and device, the individual products or articles of a series of products or articles to be handled or treated are conveyed in the first place, for example, along a path section having a rectilinear course at a low speed in order to provide improved control during their supply stage to the operating means and thus, once under control by the said operating means, along a path having a curved course at a gradually increasing speed so as to space them and subject them to particular operations, and then along a rectilinear path at a different speed for a further operation, and so on in accordance with the number and the type of operations to be carried out with respect to the type of product to be treated.

In this way it is obvious that there is a particular consequent possibility of carrying out operations for transfer or passage of products or articles to be treated from the operating means of a conveyor member to the operating means of a subsequent conveyor member, for example along one of the sections of the path having a rectilinear course, even at a slower speed, completely cancelling out any relative speed irrespective of the conveyor speed level.

In accordance with the above-mentioned U.S. application Ser. No. 433,552, the said continuously moving conveyor members are preferably provided as wheels having radial support guides on which are slidably mounted the operating means having support constructions with which are associated means for their movement along the respective radial support guide in order to move them away from and/or towards the axis of rotation of the corresponding continuously moving conveyor member such that they are continuously displaced along the above-mentioned path having mixed sections and at different speeds. The operating means provided are of the type comprising heads with take up elements having a permanent magnet or suction effect, or are constituted by gripper take-up elements, whilst the means for displacing the said operating means along the respective radial support guide are, for example, of the type having a common actuation cam, or an individual actuation cam, for example using motors of the so-called step-by-step type or other like actuation means. In addition during the stage for the transfer or passage of the product from the operating means of a conveyor wheel element to the operating means of a further conveyor wheel element operating along a rectilinear section the said operating means are orientated about respective axes parallel to the axes of the said respective conveyor wheel elements so as to maintain constant the orientation of the product along the entire rectilinear transfer section. Finally, the axes of the operating means parallel to the axes of the respective conveyor wheel elements may be provided, in terms of the combination with the said conveyor wheel elements, such that they are all parallel or, respectively, perpendicular.

The present invention relates to a handling device for automatic machines having a continuous movement in general and in particular to packing machines for prismatic products such as sweets or the like, constructed on the basis of the method disclosed in the above-mentioned Italian Patent Application in the name of the applicants and comprising one or more continuously moving rotary wheels, a plurality of these handling devices being associated with the periphery of each of these wheels with a uniform spacing and such that they may be moved radially and orientated. More particularly, this handling device, which is particularly suitable for packing machines, is provided with means having gripper take up elements which may be moved continuously along a path having sections with a mixed course at different speeds and which may maintain these gripper take up elements at a constant orientation along and relative to these mixed path sections so as to completely cancel out any relative speed with respect to the product to be wrapped irrespective of the type of conveyor speed of this product.

The invention therefore relates to a handling device for packing machines, in particular for sweets and like products, of the type comprising one or more continuously moving rotary wheels, which handling device is characterised in that it comprises a support body having an elongate prismatic polygonal shape which may be associated in predetermined numbers at a uniform spacing with the said continuously moving rotary wheel(s) in a radially slidable manner, a headed body mounted in an articulated manner so as to oscillate about the radially outermost end of the said support body about an axis parallel to the axis of rotation of the said rotary wheel(s), operating means having gripper take up elements and hoe-shaped folding elements supported in an articulated manner so as to oscillate by the said headed body oscillating about axes parallel to the axis of oscillation of the said headed oscillating body and to the axis of rotation of the said rotary wheel(s), and control means for displacing in a radial manner the said support body with the associated oscillating headed body supporting the said operating means having gripper take up elements and oscillating hoe-shaped folding elements and for providing the oscillation of the said oscillating headed body and respectively independently of the said operating means having gripper take up elements and hoe-shaped folding elements in order to cause these latter means to perform a movement of constant orientation along and relative to a continuously moving conveyor path having a mixed course comprising rectilinear, circular, spiral sections and sections which are curved in any way which follow one another in an intercalated manner and at different speeds in accordance with the type of operation to be carried out on the product completely cancelling out any relative speed with respect to the latter irrespective of its type of conveyor speed.

The attached drawings show, by way of non-limiting example, a preferred embodiment of the handling device of the invention. In the drawings:

FIG. 7 is an explanatory diagram in combination with cam control means of the operational stages of the said continuously moving wheel (not shown).

Figure 1:
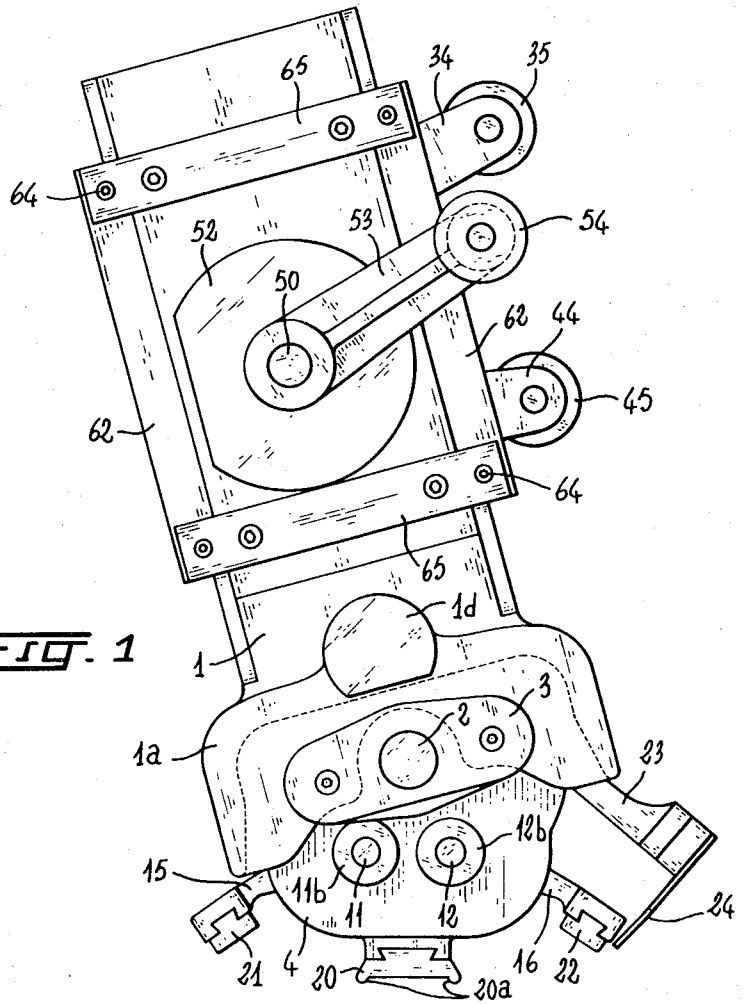
FIG. 1 is an external view of the front radial displacement arrangement of a rotary wheel continuously moving about a horizontal axis (not shown)
Figure 6:
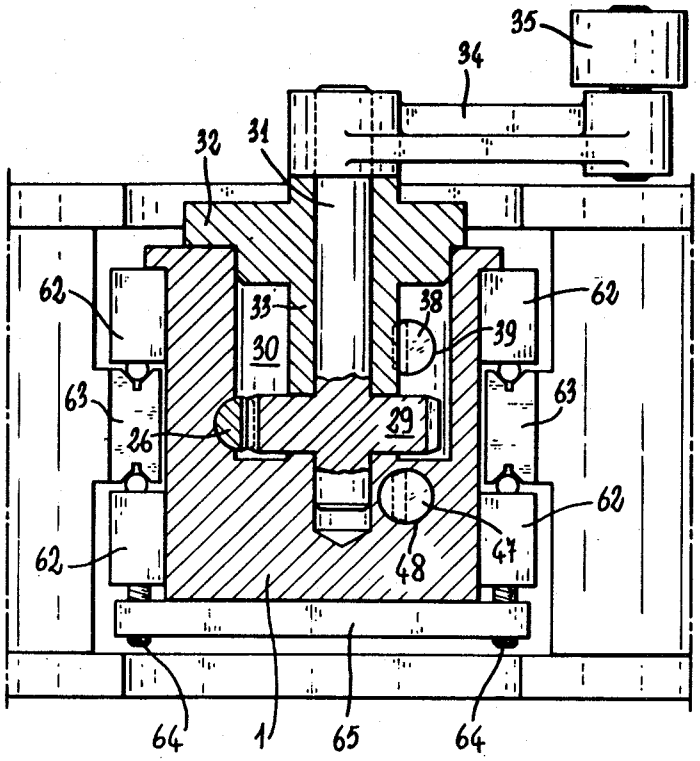

The handling device in question for automatic continuously moving machines in general and for packing machines for prismatic products such as sweets and the like in particular is described with respect to a construction of the type designed to form single wrappers of a tubular shape around sweets to be wrapped from portions of wrapping material, which construction is constituted by a support body 1 having an elongate quadrangular prismatic shape which may be associated in predetermined numbers with a uniform spacing with one or more continuously moving rotary wheels in a radially slideable manner as will be explained in detail below with reference to FIGS. 6 and 7. The body 1, at its radially outermost end (see FIG. 1) with respect to the wheel with which it is designed to be radially slideably associated, is shaped as a bell 1*a* within which there is articulated by means of a spindle 2 and by way of opposite locking elements 3 having flanged bushings, a cup-shaped headed body 4 which has its end portion projecting towards the base of the bell-shaped portion 1*a*. The cup-shaped headed body 4 is rigid with the shaft 2 by means of a screw 5 (see FIG. 2), which shaft 2 may, as will be seen below, rotate within the bore of the opposite bushing elements 3.

In the space 4*a* determined by and contained between the bell-shaped portion 1*a* of the support body 1 and the cup-shaped headed body 4, there are mounted on the spindle 2 three gears 6, 7, 8, the latter being fixed to the spindle by a screw 9 and the first two free gears being maintained in an axial position between the fixed gear 8 and a stop ring 10 mounted in an annular groove provided in the spindle 2. In FIGS. 1, 2, 3 and 7 below the spindle 2, the cup-shaped headed body 4 supports in a free manner two pins 11 and 12 which are parallel and symmetrically arranged with respect to the spindle 2 (see FIG. 3), which pins are maintained in the axial position by respective flanged elements 11*a*, 12*a* and by holding and locking rings 11*b*, 12*b*.

Figure 5:
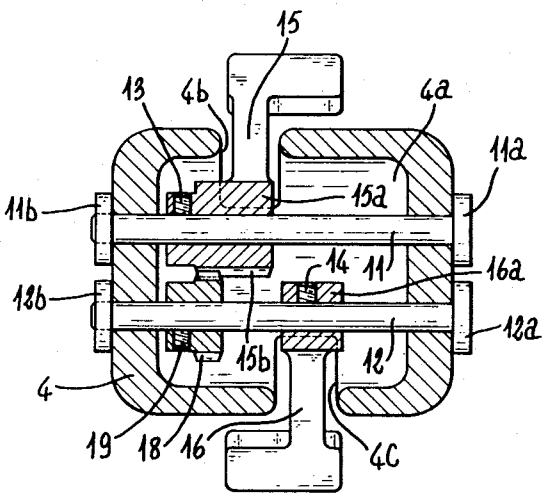

Each of the free pins 11 and 12 has keyed on it in a fixed manner by means of a respective screw 13, 14 (see FIG. 5) a corresponding arm 15, 16 forming the elements or prongs of a gripper take up element 17. The keying hub 15*a* of the gripper arm 15 is provided by toothing 15*b* with which there is engaged the toothing of a gear 18 keyed in a fixed manner by means of a screw 19 on the pin 12 on which is keyed in a fixed manner via its hub 16*a* the other gripper arm 16. In this way the gripper arms 15 and 16 forming the elements or prongs of the gripper element 17 are caused to rotate in opposite directions in the manner described below, moving within a respective slot or notch 4*b*, 4*c* provided accordingly in the cup-shaped headed body 4.

Figure 3:
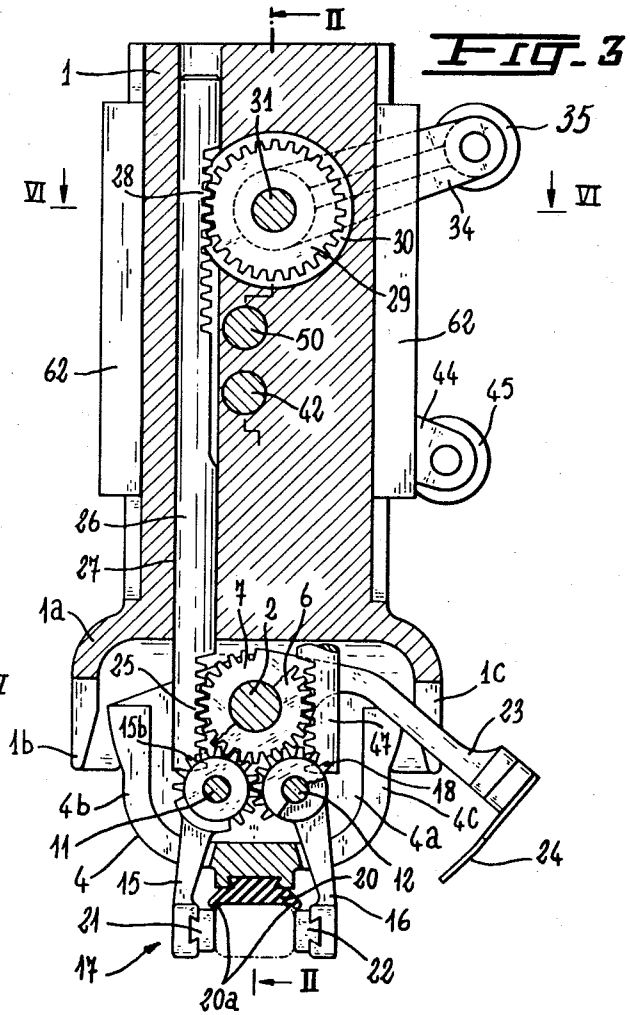
Figure 2:
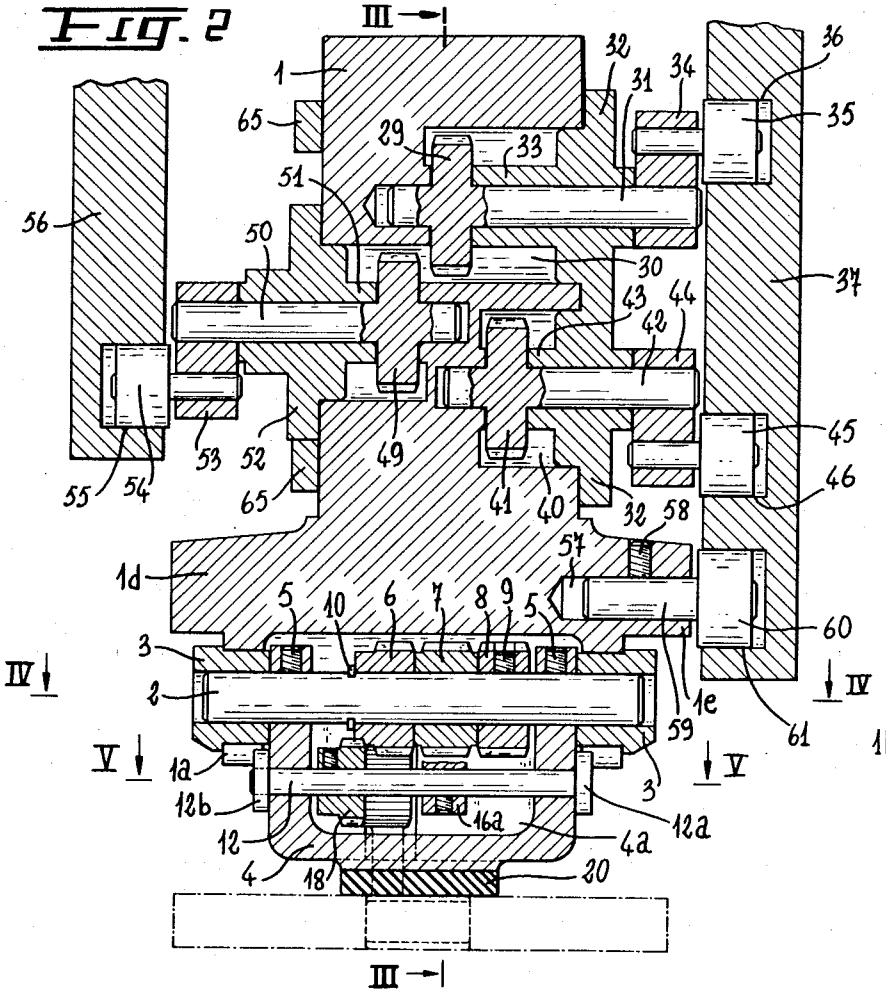
FIG. 2 is a section along the line II—II shown in FIG. 3 which is a view along the line III—III shown in FIG. 2, FIGS. 4, 5 and 6 are sections along the transverse lines IV—IV, V—V, VI—VI respectively shown in FIGS. 2 and 3

The external central portion of the base of the cup-shaped headed body 4 has fixed to it in a detachable and interchangeable manner a block 20 of resilient material, for exampled hard rubber, see FIG. 3, having an elongate shape, see FIG. 2, having its longitudinal edges 20*a* extending beyond the plane of its central zone, i.e. in a raised manner, providing a configuration substantially in the shape of an upturned channel, see FIG. 3, whilst the free ends of the arm 15, 16 forming the elements or prongs of the gripper 17 have fixed to them in a detachable manner a corresponding block 21, 22 also of resilient material similar to that from which the block 20 is formed. The blocks of resilient material 20, 21, 22 which are detachably fixed in an interchangeable manner to the respective support portions are provided with dimensions which may be varied as a function of the dimensions of the product to be handled, i.e. they are part of the machine components or elements which, in jargon, in automatic machines constitute the so-called sized parts or components.

The toothing of the gear 7, which is free on the spindle 2, is provided on the hub of an element 23 having an arm which may oscillate, as will be explained below, in the slot or notch 4*c* of the cup-shaped headed body 4 and which at its free end supports in a fixed manner, in any known way, a hoe-shaped folding element 24. For this purpose, the bell-shaped portion 1*a* of the support body 1 is provided with slot or notches 1*b*, 1*c* which are coplanar with the slots or notches 4*b*, 4*c* of the cup-shaped headed body 4 (see in particular FIG. 3). This geared toothing 7 engages with a rack-toothed end section 25 of a rod 26 engaged slideably in a hole or seat 27 provided longitudinally in the support body 1. In the vicinity of its other end the said rod 26 has a further rack-toothed section 28 engaged with a gear 29 housed in a chamber 30 provided transversally and passing through the said support body 1 and rigid with a pin 31 supported by the said body 1 and by a plate 32 with a closure hub 33 on one side of the chamber 30 of the said body 1. One end of the pin 31 projects from the chamber 30 through the support and closure plate 32 and there is fixed on this outer end one end of a lever 34 on whose other end there is mounted a cam follower idler 35 engaged in a cam path 36 provided in a disc 37 having several cam paths (see FIGS. 2 and 7). In this way, the element 23 with the arm and the associated hoe-shaped folding element 24 constitute an oscillating folding element whose operation will be described below.

Figure 4:
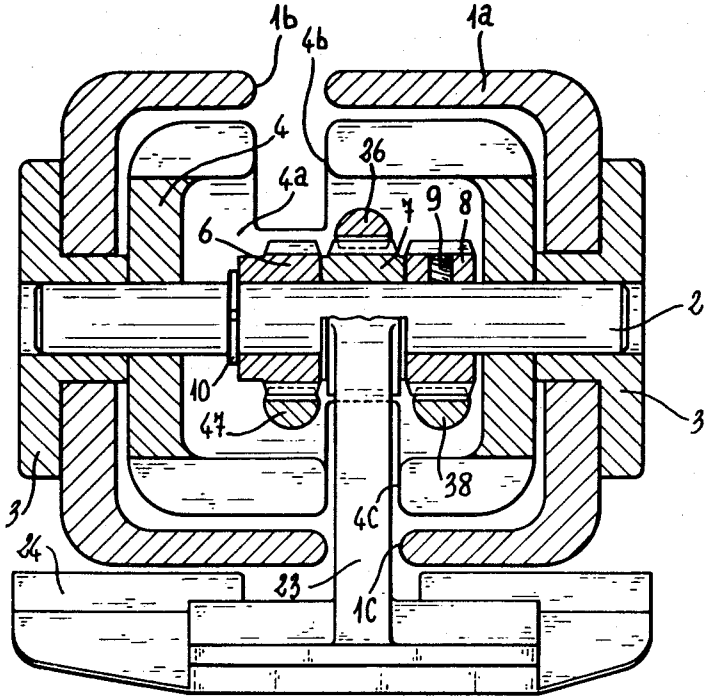
Figure 4:
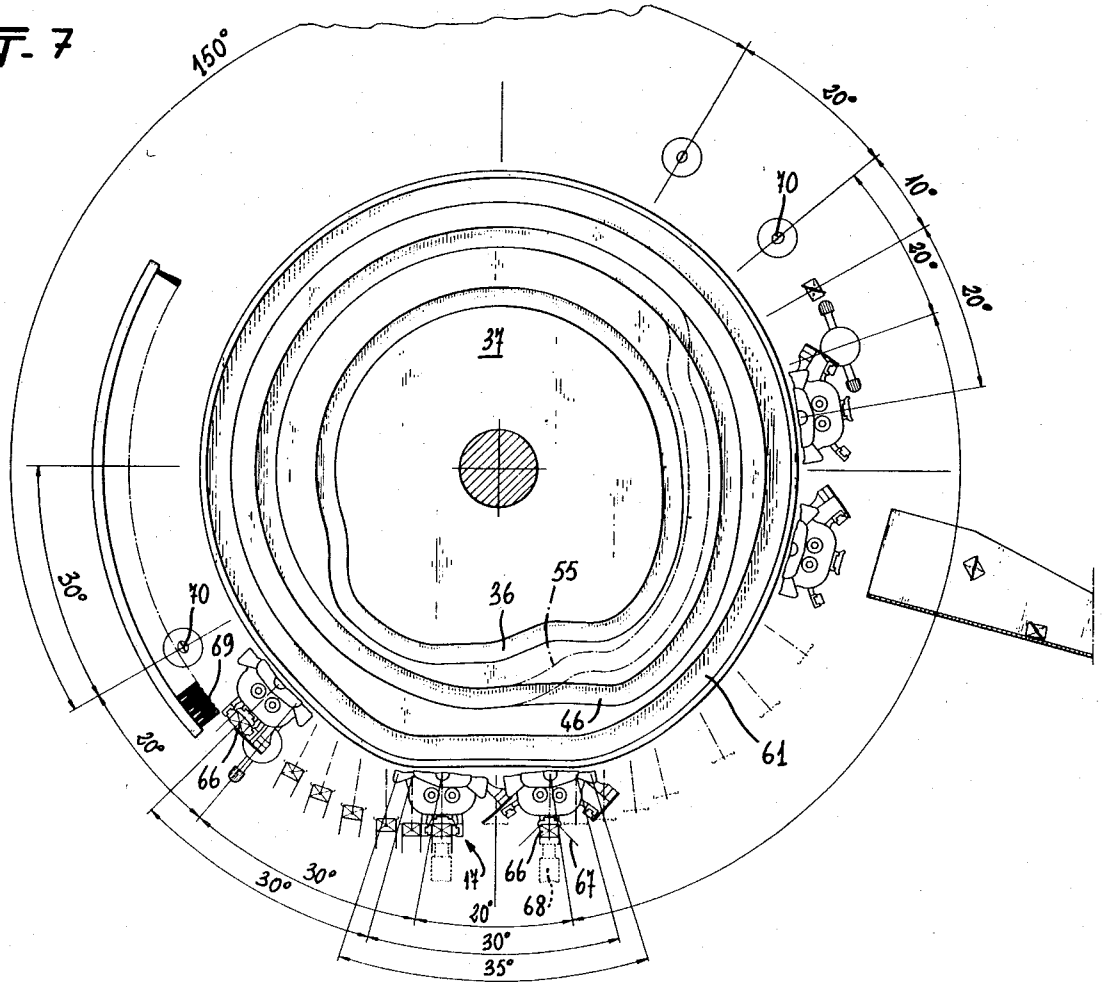

The toothing of the gear 8 fixed to the spindle 2 engages with a second rack 38 (see FIGS. 4 and 6) which is engaged slideably in a hole or seat 39 provided longitudinally in the support body 1 and extending through a second chamber 40 (see FIG. 2) provided in the support body 1, where it engages with a gear 41 rigid with a pin 42 supported by the body 1 and by a second hub 43 provided in the above-mentioned support and closure plate 32. One end of the pin 42 projects from the chamber 40 through the support and closure plate 32 and there is fixed to this outer end one end of a lever 44 on whose other end there is mounted a cam follower idler 45 engaged in a cam path 46 provided in the said disc 37 having several cam paths (see FIGS. 2 and 7). In this way, the headed body 4 to which there is fixed the spindle 2 supporting in a free manner the control element for the gripper member 17 and the hoe-shaped folding element 23, 24 described above, is caused to oscillate for the operations described below.

However, the toothing of the gear 6 which is free on the spindle 2 engages with a third rack 47 (see FIGS. 3, 4 and 6) engaged slideably in a hole or seat 48 provided longitudinally in the support body 1 and extending through the said chamber 30 of the support body 1 where it engages with a gear 49 rigid with a pin 50 supported by the body 1 and by the hub 51 of a support and closure plate 52 on the side opposite to that on which the support and closure plate 32 is provided. One end of the pin 50 projects from the chamber 30 through the support and closure plate 52 and there is fixed to this outer end one end of a lever 53 on whose other end there is mounted a cam follower idler 54 engaged in a cam path 55 provided in a second cam disc 56 provided in mirror-symmetry opposite to the first disc 37 having several cam paths (see FIGS. 2 and 7). In this way it is possible to cause the counter-rotation of the gripper arms 15 and 16 by opening and closing the gripper member 17.

As stated above, a handling device of this type may be associated, in predetermined numbers and with a uniform spacing, with individual continuously moving rotating wheels in a radially slideable manner and for this purpose there is provided at the intersection between the body 1 having an elongate quadrangular prismatic shape and its bell-shaped end 1*a* two projections 1*d*, 1*e* extending in a direction substantially parallel to the axis of rotation of the corresponding continuously moving rotary wheel and therefore to the axis of oscillation of the headed body 4 rigid with the spindle 2. In at least one of the projections 1*d*, 1*e*, in the embodiment illustrated in the projection 1*e* (see FIG. 2), there is provided a hole 57 parallel to the spindle 2, in which hole 57 there is engaged and fixed by a screw 58 a pin 59 supporting at its end external to this hole 57 a cam follower idler 60 engaged in a cam path 61 provided in the above-mentioned disc 37 having several cam paths (see FIGS. 2 and 7).

The radial sliding of the handling device takes place by means of sliding guide mechanisms and lateral elements for the recycling of ball bearings of the type commercially available under the tradename SK which are produced and sold by the international company Schneeberger. These sliding guides, indicated by 63, are fixed, in the case shown by way of example (see FIG. 6) to opposite faces of the individual radial cavities provided in the wheel with which are associated the handling devices, whilst the ball bearing recycling elements, indicated by 62, are fixed in pairs to corresponding opposite faces of the body 1 of the said handling devices. The adjustment or setting of these mechanisms is carried out by adjustment screws 64 which may be screwed into plates or fillets 65 rigid with the body 1 and exerting pressure on at least one of each pair of elements 62 (see FIG. 6).

FIG. 7 shows, as mentioned above, a diagram of the operation of one of a plurality of handling devices in accordance with the construction described above and set out in the claims, these devices being fitted with a unform spacing to a continuously moving rotary wheel about a horizontal axis in accordance with the apparatus for wrapping sweets as disclosed in the applicant's further copending U.S. patent application Ser. No. 522,185 sweets for example in a wrapper having a so-called double twist shape. As is known, this double twist wrapper involves forming around the sweet to be wrapped a tubular wrapping extending beyond the ends of the sweet over a certain length and twisting the opposite ends of the tubular wrapping in the vicinity of the ends of the sweet itself thereby providing the characteristic double twist wrapper shape.

The sweets to be wrapped are supplied to this apparatus in horizontal alignment in a predetermined sequence or spacing by means of devices or apparatus of known type for the so-called spacing of these sweets or like products, or by means of the apparatus in accordance with the applicant's copending U.S. patent application Ser. No. 522,184, filed Aug. 10, 1983. The wrapping material, usually wound in spools, is also supplied in a horizontal arrangement by means of apparatus of known type.

Consequently, with reference to FIG. 7 it can be seen that by way of example for the gripper member 17 of the handling devices of the invention, used with a rotary wheel moving continuously about a horizontal axis of the apparatus of the above-mentioned patent application Ser. No. 522,185, there is provided a horizontal rectilinear path section for simulating rest in the lower zone of the rotary wheel, corresponding to 35° of rotation of this rotary wheel. This is achieved by the radial displacement of the handling device by means of the cam path 61 and the simultaneous oscillation of the head 4 about the axis of the spindle 2 by means of the cam path 46 for an orientation different from the radial orientation of the head 4, so as to obtain and maintain the parallelism of the said head 4 and the perpendicularity of the plane of symmetry of the prongs or arms of the gripper of the gripper member 17 with respect to the horizontal plane of supply of the sweets and the related wrapping material. Of this 35° of the horizontal, rectilinear rest simulation path, 30° are used for carrying out the operation or stage of passage or transfer of the sweet 66 and the corresponding superimposed wrapping material 67 from the elements 68 of the supply apparatus to the gripper elements 17 of the handling device of the invention, which gripper elements 17 are closed for take up in the intermediate 20° under the action of the cam path 55. After this 30° of rest simulation and with the sweet and the associated wrapping material folded over the sweet in the shape of an upturned U between the prongs of the closed gripper member 17, the head 4 is caused to oscillate during the following 30° so as to re-orientate it radially, whilst from the position of the closed gripper element 17 and through the subsequent 30° the hoe-shaped folding device 23, 24 is caused to oscillate by the cam 36 and folds the lower limb of the upturned U of the wrapping material over the lower surface of the sweet. The hoe-shaped folding device 23, 24 remains in this position for a further 20° of rotation during which the sweet 66 reaches a fixed blade 69 which folds the other limb of the upturned U of the wrapping material over the previously folded limb forming the tubular wrapper around the sweet. During the said 20° of rest of the hoe-shaped folding device 23, 24 the gripper and twisting elements 70 also close in order to take up the ends of the said tubular wrapper and, whereas the folding device returns to its initial position during the following 30° and remains there for the remaining 280° of rotation of the wheel, the twisting elements 70 are caused to rotate about themselves in order to twist these ends of the tubular wrapper for 150° gradually coming closer to the sweet. After this, the gripper and twisting elements 70 are subsequently moved towards the sweet for the next 20° in order to carry out the so-called compaction operation on the wrapping material in its twisted zone, and are then opened during the following 20° in order to release the sweet wrapped in the so-called double twist wrapper. The cycle is then repeated.

A handling device having the construction described above and set out in the claims of the present invention, used in practice in predetermined numbers in combination with the apparatus of the above-mentioned patent application Ser. Nos. 522,184 and 522,185, provides for the construction of wrapping machines having very high production speeds which may wrap 2000 or more sweets in the first minute, which production speeds are impossible with and more than double that of wrapping machines at present available on the international market.

It is obvious that in the practical embodiment of the above construction of the handling device in question any modifications and variants suggested by practice and by its case of application may be made thereto in all cases within the scope of the invention claimed below.

I claim:

1. A handling device for packing machines, in particular for sweets and like products of the type comprising one or more continuously moving rotary wheels, characterised in that it comprises a support body having an elongate polygonal prismatic shape which may be associated in predetermined numbers at a uniform spacing with the said wheel(s) moving continuously in a radially slideable manner, a headed body mounted in an articulated manner to oscillate at the radially outermost end of the said support body about an axis parallel to the axis of rotation of the said rotary wheel(s), operating means having gripper take up elements and hoe-shaped folding devices supported by the said headed body in an articulated manner to oscillate about axes parallel to the axis of oscillation of the oscillating headed body and parallel to the axis of rotation of the said rotary wheel(s), and control means for moving in a radial direction the support body with the associated oscillating headed body supporting the oscillating operating means with gripper take up elements and hoe-shaped folding devices and for causing the oscillation of the oscillating headed body and independently the oscillation of the oscillating operating means having gripper take up elements and hoe-shaped folding devices in order to cause these latter means to perform a movement of constant orientation along and relative to a path for continuous conveyor movement having a mixed course with sections which are rectilinear, spiral, circular, and curved in any way which follow one another in an intercalated manner and at different speeds in accordance with the type of operation to be carried out on the product thereby cancelling out completely any relative speed with respect to the latter irrespective of its conveyor speed type.

2. A handling device as claimed in claim 1, characterised in that the said oscillating headed body has a hollow cup shape and is articulated at the outermost end of the support body which is shaped as a bell so as to provide a closed chamber for housing three gears mounted on a spindle passing through the said housing chamber and forming the axis of articulation of the said oscillating headed body, the said oscillating headed body and one of the three gears being rigid with the articulation spindle whilst the other two gears are free and lead to the operating means having gripper take up elements and hoe-shaped folding elements, rack control means in respective engagement with the three gears and with respective gear transmission means associated with cam follower means enabling the said respective oscillation movements of the headed means and the operating means having gripper take up elements and hoe-shaped folding mechanisms.

* * * * *